US008117758B1

(12) United States Patent
Crochet

(10) Patent No.: US 8,117,758 B1
(45) Date of Patent: Feb. 21, 2012

(54) SCRIBE TOOL

(76) Inventor: Marty Crochet, Cutoff, LA (US)

( * ) Notice: Subject to any disclaimer, the term of this patent is extended or adjusted under 35 U.S.C. 154(b) by 0 days.

(21) Appl. No.: 12/713,247

(22) Filed: Feb. 26, 2010

(51) Int. Cl.
*B43L 13/02* (2006.01)

(52) U.S. Cl. ..... 33/41.6; 33/42; 33/194

(58) Field of Classification Search ..... 33/41.6, 33/41.1, 41.4, 42, 194
See application file for complete search history.

(56) References Cited

U.S. PATENT DOCUMENTS 1,732,906 A * 10/1929 Morton ..... 33/490
2,119,852 A * 6/1938 Corbin ..... 33/41.6
2,328,678 A * 9/1943 Roos ..... 33/42
2,561,585 A * 7/1951 McKillop ..... 33/41.1
2,717,013 A * 9/1955 Van Zwalenburg ..... 144/253.1
3,245,146 A * 4/1966 Rogers ..... 33/39.2
3,805,391 A * 4/1974 Glasgow ..... 33/41.6
4,121,343 A * 10/1978 Duggins et al. ..... 33/42
5,862,601 A * 1/1999 O'Brien et al. ..... 33/42
6,907,675 B1 * 6/2005 Hutchings ..... 33/666
7,591,073 B1 * 9/2009 Eckles et al. ..... 33/194
7,730,623 B2 * 6/2010 Lien ..... 33/197
2008/0163501 A1 * 7/2008 Williams ..... 33/42

* cited by examiner

*Primary Examiner* — Christopher Fulton
(74) *Attorney, Agent, or Firm* — Kenneth L Tolar

(57) ABSTRACT

A scribe tool includes a three-dimensional, polygonal block having two opposing ends with a plurality of planar, non-orthogonal surfaces formed therebetween. A bore extends from one of the ends to another and is offset from the block's central, longitudinal axis. Each planar surface is spaced a discrete distance from the central axis that corresponds to one of a plurality of conventional measurements. The tool allows a craftsman to form a trim line along an architectural item that conforms to surface irregularities on an adjacent wall.

5 Claims, 1 Drawing Sheet

SCRIBE TOOL

CROSS REFERENCE TO RELATED APPLICATIONS

None.

BACKGROUND OF THE INVENTION

The present invention relates to a uniquely-designed scribe block that allows a carpenter to trim architectural objects to conform to abutting wall irregularities.

DESCRIPTION OF THE PRIOR ART

Various architectural enhancements such as paneling, cabinets and similar items, are often attached to walls to enhance the appearance or utility of a particular room. Mounting such enhancements in the corner of a room is tedious and problematic, particularly when either the supporting or abutting wall is not vertical, or contains surface irregularities. Typically, the craftsman forms a leading edge on the architectural item that perpendicularly extends from the top edge to the bottom to approach or engage the abutting wall. The item is then secured to the supporting wall in a level, vertical orientation. If the abutting wall is not perfectly vertical, or if it contains surface irregularities such as pockets or bubbles, unsightly gaps may exist between the item and the wall. Accordingly, there is currently a need for a tool that assists a craftsman with installing certain architectural enhancements.

The present invention addresses this need by providing a scribe tool formed of a polygonal block having an offset bore for receiving a marking instrument such as a pencil. A plurality of planar surfaces are each spaced a discrete distance from the bore's axis to allow a craftsman to form a guide line along an architectural enhancement that compensates for surface irregularities on an adjacent wall. The craftsman then trims the architectural item along the guide line to form a leading edge that substantially conforms to the abutting wall.

SUMMARY OF THE INVENTION

The present invention relates to a scribe tool including a three-dimensional, polygonal block having two opposing ends with a plurality of planar, non-orthogonal surfaces formed therebetween. A bore extends from one of the ends to another and is offset from the block's central, longitudinal axis. Each planar surface is spaced a discrete distance from the central axis that corresponds to one of a plurality of conventional measurements. The tool allows a craftsman to form a trim line along an architectural item that conforms to surface irregularities on an adjacent wall.

It is therefore an object of the present invention to provide a tool that assists a worker with installing certain architectural items.

It is another object of the present invention to provide a tool that allows a worker to easily reconfigure a leading edge of an architectural item to conform to irregular abutting walls.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
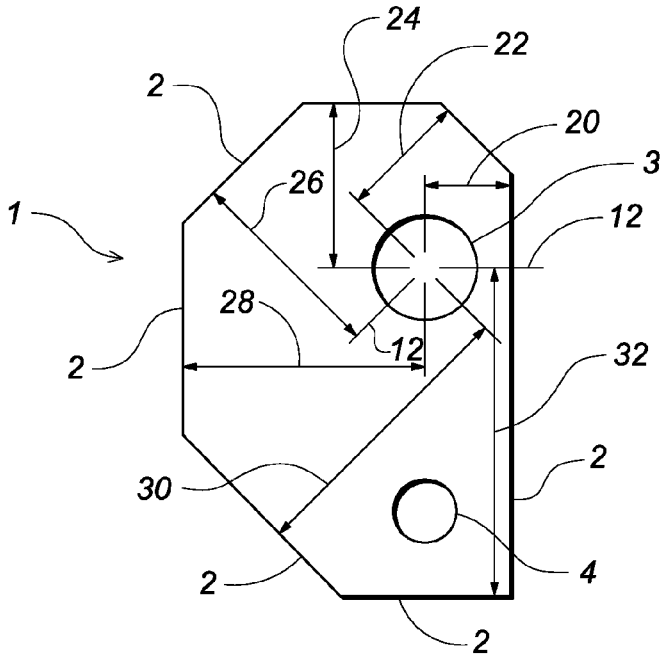
FIG. 1 is an end view of the block.
Figure 2:
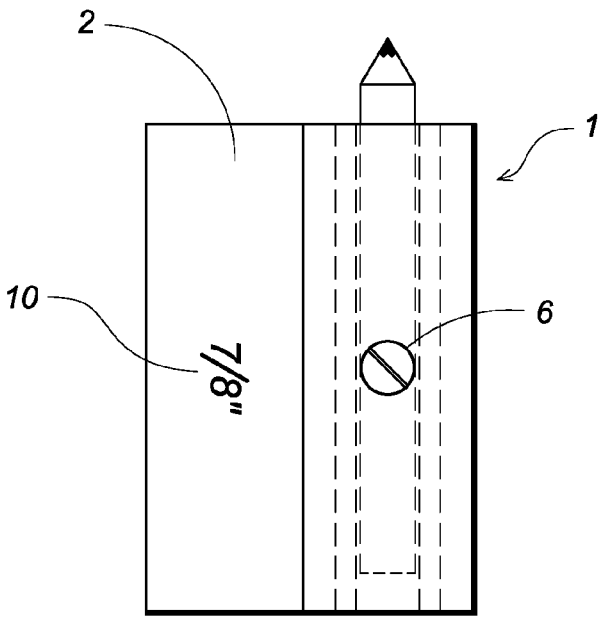
FIG. 2 is a front, plan view of the block.
Figure 3:
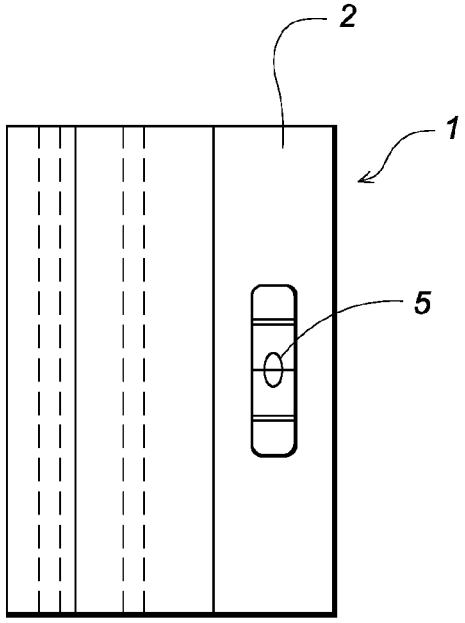
FIG. 3 is a rear, plan view of the block.

The present invention relates to a scribe tool including a three-dimensional, polygonal block 1 having two opposing ends with a plurality of planar, non-orthogonal surfaces 2 formed therebetween. A bore 3 extends from one of the ends to another and is offset from the block's central, longitudinal axis.

An imaginary line perpendicularly extending from each planar surface to a second imaginary line 12 normal to the bore's central axis has a discrete length that corresponds to common measurements normally used in construction projects. For example, the lengths of the pertinent lines may be as follows:

20—¼ inch;
22—⅜ inch;
24—½ inch;
26—⅝ inch;
26—¾ inch;
30—⅞ inch;
32—1 inch.

However, as will be readily apparent to those skilled in the art, the discrete distances can be varied according to a particular application provided that each line's length varies relative to that of every other line. Furthermore, each line may have a discrete distance as determined in metric or English units, or a combination thereof. Reference indicia 10 representing each of the discrete distances may be imprinted on each surface to assist the craftsman with selecting the block orientation prior to scribing.

On an end of the block, proximal the bore, is a cylindrical cavity 4 for receiving an accessory item such as a penlight. Preferably, a bubble level 5 is disposed on one of the planar surfaces to assist a worker with properly orienting various objects. A set screw 6 on another surface anchors a writing instrument within the bore.

Accordingly, a craftsman first places the architectural item within a corner, immediately adjacent to an abutting wall. The item is then vertically oriented and the craftsman measures the widest gap formed between the item and the abutting wall. The planar surface that is spaced a distance from the aperture that most closely corresponds to the measured gap is placed against the abutting wall. A writing instrument is inserted into the bore and the craftsman slides the block from the upper end of the item to the lower end to form a trim line along the leading edge. The item is then cut along the trim line to form a leading edge that substantially conforms to the abutting wall.

The above-described device is not limited to the exact details of construction and enumeration of parts provided herein. For example, though the device is primarily depicted and described as having seven non-orthogonal surfaces, the number of surfaces can be varied. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A scribe tool comprising:

a polygonal block having two opposing ends with a plurality of planar, non-orthogonal surfaces formed therebetween, said block further having a bore extending from one of said ends to another of said ends, said bore offset from a central longitudinal axis of said block, each of said non-orthogonal surfaces spaced a discrete, unique distance from a central axis of said bore that is unequal to a distance from a central axis of said bore to any other of said non-orthogonal surfaces;

a writing instrument received within said bore whereby each of said non-orthogonal surfaces allow a craftsman to form a trim line along an architectural structure by using one of said non-orthogonal surfaces to guide said block along an abutting surface.

2. The scribe tool according to claim 1 further comprising a cylindrical cavity on an end of the block for receiving an accessory item.

3. The scribe tool according to claim 1 further comprising a bubble level disposed on one of the planar surfaces to assist a worker with properly orienting various objects.

4. The scribe tool according to claim 1 further comprising a set screw on one of said planar surfaces for anchoring said writing instrument within the bore.

5. A scribe tool comprising:

an elongated polygonal block having two opposing planar end walls with a plurality of planar sidewalls perpendicularly extending therebetween, each of said sidewalls being non-orthogonal relative to any of said sidewalls adjacent thereto, said block further having a bore formed in one of said end walls, said bore offset from a central longitudinal axis of said block, each of said non-orthogonal sidewalls spaced a discrete, unequal distance from a central axis of said bore;

a writing instrument received within said bore whereby each of said non-orthogonal surfaces allow a craftsman to form a trim line along an architectural structure by using one of said non-orthogonal surfaces to guide said block along an abutting surface.

* * * * *